US007998292B2

(12) United States Patent
Taylor et al.

(10) Patent No.: US 7,998,292 B2
(45) Date of Patent: Aug. 16, 2011

(54) BURN RATE ENHANCEMENT OF BASIC COPPER NITRATE-CONTAINING GAS GENERANT COMPOSITIONS

(75) Inventors: Robert D. Taylor, Hyrum, UT (US); Ivan V. Mendenhall, Providence, UT (US)

(73) Assignee: Autoliv ASP, Inc., Ogden, UT (US)

( * ) Notice: Subject to any disclaimer, the term of this patent is extended or adjusted under 35 U.S.C. 154(b) by 1571 days.

(21) Appl. No.: 10/971,211

(22) Filed: Oct. 22, 2004

(65) Prior Publication Data

US 2006/0096679 A1 May 11, 2006

(51) Int. Cl.

| | |
|---|---|
| ***C06B 31/00*** | (2006.01) |
| ***C06B 31/06*** | (2006.01) |
| ***D03D 23/00*** | (2006.01) |
| ***D03D 43/00*** | (2006.01) |

(52) U.S. Cl. ..... 149/45; 149/73; 149/109.2; 149/109.4

(58) Field of Classification Search ..... 149/45, 149/73, 109.2, 109.4

See application file for complete search history.

(56) References Cited

U.S. PATENT DOCUMENTS

| | | | | |
|---|---|---|---|---|
| 5,197,758 | A | 3/1993 | Lund et al. | |
| 5,608,183 | A | 3/1997 | Barnes et al. | |
| 5,635,668 | A | 6/1997 | Barnes et al. | |
| 5,962,808 | A | 10/1999 | Lundstrom | |
| 6,083,331 | A | 7/2000 | Taylor et al. | |
| 6,103,030 | A | 8/2000 | Taylor et al. | |
| 6,143,102 | A | 11/2000 | Mendenhall et al. | |
| 6,383,318 | B1 | 5/2002 | Taylor et al. | |
| 6,416,599 | B1 | 7/2002 | Yoshikawa et al. | |
| 6,517,647 | B1 * | 2/2003 | Yamato | 149/45 |
| 6,592,691 | B2 | 7/2003 | Taylor et al. | |

OTHER PUBLICATIONS

U.S. Appl. No. 10/704,499, filed Nov. 2003, Mendenhall et al.

* cited by examiner

*Primary Examiner* — James E McDonough
(74) *Attorney, Agent, or Firm* — Sally J. Brown; Pauley Petersen & Erickson

(57) ABSTRACT

The inclusion of between about 15 to about 60 formulation weight percent of a reaction product of basic copper nitrate and at least one transition metal complex of 5-aminotetrazole, wherein the at least one transition metal complex of 5-aminotetrazole and the basic copper nitrate are included in a weight ratio of no more than 1 part of the at least one transition metal complex of 5-aminotetrazole per 1 part of basic copper nitrate in azide fuel-free gas generant formulations exhibiting increased burn rates, as compared to the same formulation without the inclusion of that reaction product.

22 Claims, 1 Drawing Sheet

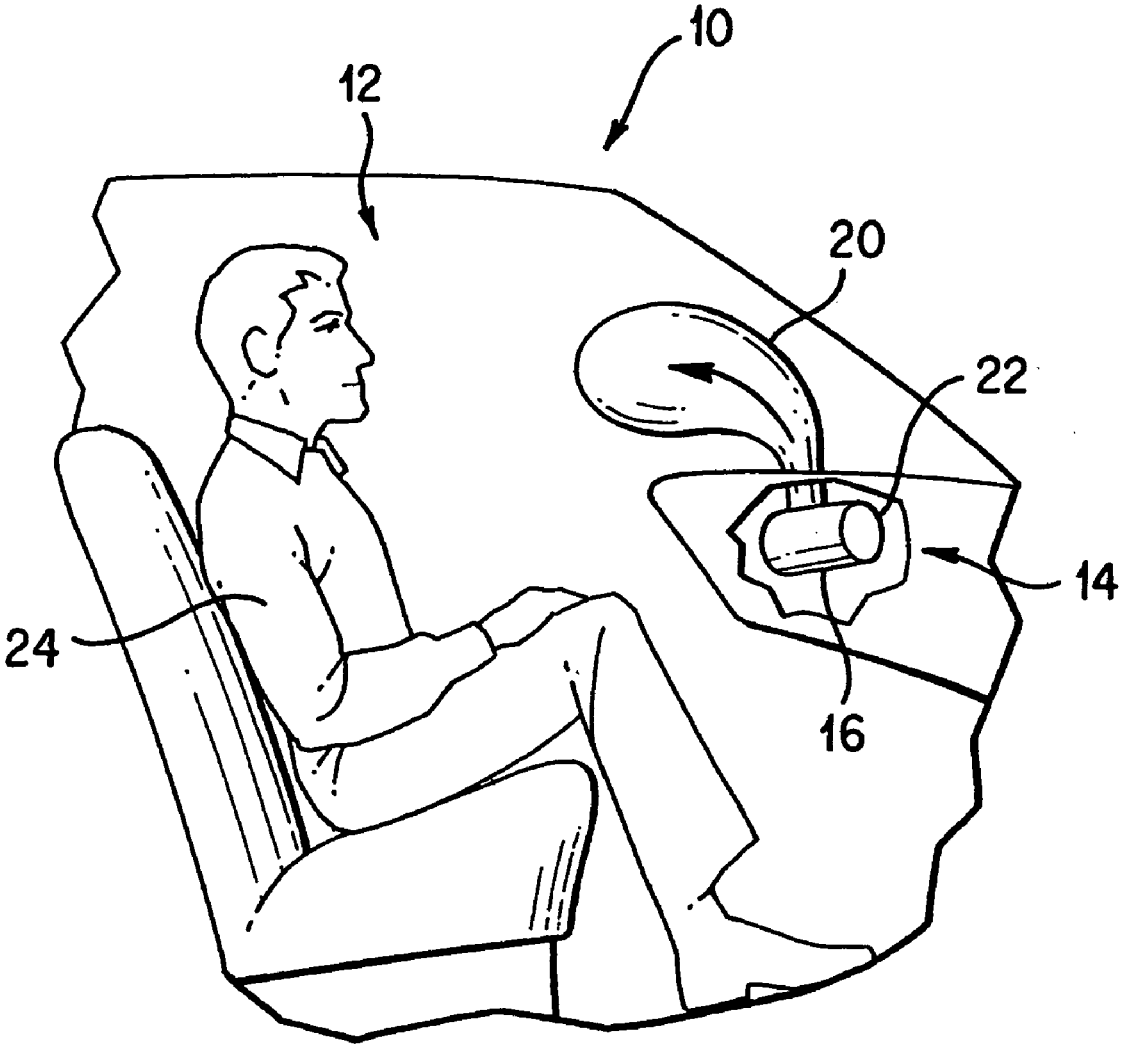
FIGURE

BURN RATE ENHANCEMENT OF BASIC COPPER NITRATE-CONTAINING GAS GENERANT COMPOSITIONS

BACKGROUND OF THE INVENTION

This invention relates generally to gas generant materials such as used in the inflation of automotive inflatable restraint airbag cushions and, more particularly, to the enhancement of the rate at which such materials burn or otherwise react.

Gas generating materials are useful in a variety of different contexts. One significant use for such compositions is in the operation of automotive inflatable restraint airbag cushions.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Such systems typically also include one or more crash sensors mounted on or to the frame or body of the vehicle to detect sudden decelerations of the vehicle and to electronically trigger activation of the system. Upon actuation of the system, the cushion begins to be inflated or expanded, in a matter of no more than a few milliseconds, with gas produced or supplied by a device commonly referred to as an "inflator." In practice, such an airbag cushion is desirably deployed into a location within the vehicle between the occupant and certain parts of the vehicle interior, such as a door, steering wheel, instrument panel or the like, to prevent or avoid the occupant from forcibly striking such part(s) of the vehicle interior. As a consequence, nearly instantaneous gas generation is generally desired and required for the effective operation of such inflatable restraint installations.

Various gas generant compositions have heretofore been proposed for use in vehicular occupant inflatable restraint systems. Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials was in accordance with industry specifications, guidelines and standards, such use could potentially involve or raise potential concerns such as involving the safe and effective handling, supply and disposal of such gas generant materials. Thus, there has been an ongoing need for further improved, safe and effective alternative gas generants, such as composed of an azide-free fuel material and an oxidizer therefor, such as upon actuation react to form or produce an inflation gas for inflating vehicular safety restraint devices.

In view of this need, significant efforts have been directed to minimizing or avoiding the use of sodium azide in automotive airbag inflators. Through such efforts, various combinations of non-azide fuels and oxidizers have been proposed for use in gas generant compositions. These non-azide fuels are generally desirably less toxic to make and use, as compared to sodium azide, and may therefore be easier to dispose of and thus, at least in part, found more acceptable by the general public. Further, non-azide fuels composed of carbon, hydrogen, nitrogen and oxygen atoms typically yield all gaseous products upon combustion. As will be appreciated by those skilled in the art, fuels with high nitrogen and hydrogen contents and a low carbon content are generally attractive for use in such inflatable restraint applications due to their relatively high gas outputs (such as measured in terms of moles of gas produced per 100 grams of gas generant material).

Lund et al., U.S. Pat. No. 5,197,758, issued 30 Mar. 1993, relates generally to gas generant compositions or propellants which comprise a non-azide fuel which is a transition metal compound of an aminoarazole. As disclosed, preferred transition metal complexes are zinc and copper complexes of 5-aminotetrazole and 3-amino-1,2,4-triazole, with the zinc complexes most preferred. The compositions are also disclosed as including a conventional oxidizer such as potassium nitrate or strontium nitrate.

Most oxidizers known in the art and commonly employed in gas generant compositions are metal salts of oxygen-bearing anions (such as nitrates, chlorates and perchlorates, for example) or metal oxides. Unfortunately, upon combustion, the metallic components of such oxidizers typically end up as a solid and thus reduce the relative gas yield realizable therefrom. Consequently, the amount of such oxidizers in a particular formulation typically affects the gas output or yield from the formulation. If oxygen is incorporated into the fuel material, however, less of such an oxidizer may be required and the gas output of the formulation can be increased.

In addition to low toxicity and high gas outputs, preferred gas generant materials are desirably relatively inexpensive, thermally stable (i.e., desirably decompose only at temperatures greater than about 160° C.), and have a low affinity for moisture.

Moreover, in addition to the above-identified desirable properties and characteristics, gas generant materials for use in automotive inflatable restraint applications must be sufficiently reactive such that upon the proper initiation of the reaction thereof, the resulting gas producing or generating reaction occurs sufficiently rapidly such that a corresponding inflatable airbag cushion is properly inflated so as to provide desired impact protection to an associated vehicle occupant. In general, the burn rate for a gas generant composition can be represented by the equation (1), below:

$$r_b = k(P)^n \quad (1)$$

where,

| | |
|---|---|
| $r_b$ = | burn rate (linear) |
| k = | constant |
| P = | pressure |
| n = | pressure exponent, where the pressure exponent is the slope of a linear regression line drawn through a log-log plot of burn rate versus pressure. |

Guanidine nitrate ($CH_6N_4O_3$) is a non-azide fuel with many of the above-identified desirable fuel properties and which has been widely utilized in the automotive airbag industry. For example, guanidine nitrate is commercially available, relatively low cost, non-toxic, provides excellent gas output due to a high content of nitrogen, hydrogen and oxygen and a low carbon content and has sufficient thermal stability to permit spray dry processing. Unfortunately, guanidine nitrate suffers from a lower than may be desired burn rate. Thus, there remains a need and a demand for an azide-free gas generant material which may more effectively overcome one or more of the problems or shortcomings described above.

Commonly assigned Mendenhall, U.S. Pat. No. 6,550,808, issued 22 Apr. 2003, the disclosure of which is fully incorporated herein by reference, relates generally to gas generant compositions which desirably include or contain guanylurea nitrate (also known as dicyandiamidine and amidinourea). In particular, guanylurea nitrate advantageously has a relatively high theoretical density such as to permit a relatively high loading density for a gas generant material which contains such a fuel component. Further, guanylurea nitrate exhibits excellent thermal stability, as evidenced by guanylurea nitrate having a thermal decomposition temperature of 216° C. In addition, guanylurea nitrate has a large negative heat of formation (i.e., −880 cal/gram) such as results in a cooler burning gas generant composition, as compared to an otherwise similar gas generant containing guanidine nitrate.

While the inclusion or use of guanylurea nitrate in gas generant materials can serve to minimize or avoid reliance on the inclusion or use of sodium azide or other similar azide materials while providing improved burn rates and overcoming one or more of the problems, shortcomings or limitations such as relating to cost, commercial availability, low toxicity, good thermal stability and low affinity for moisture, even further improvement in the burn rate of gas generant formulations may be desired or required for particular applications.

Basic copper nitrate ($Cu(NO_3)_2.3Cu(OH)_2$) (sometimes referred to herein by the notation "BCN") has or exhibits various properties or characteristics including, for example, high gas output, density and thermal stability and relatively low cost such as to render desirable the use or gas generant composition inclusion thereof as an oxidizer. The use of such basic copper nitrate or related materials has been the subject of various patents including Barnes et al, U.S. Pat. No. 5,608,183, issued 4 Mar. 1997; Barnes et al, U.S. Pat. No. 5,635,688, issued 3 Jun. 1997, and Mendenhall et al., U.S. Pat. No. 6,143,102, issued 7 Nov. 2000, the disclosures of which are fully incorporated herein by reference.

In practice, it is generally desired or required that inflators for inflatable restraint systems be able to supply or provide inflation gas in predetermined mass flow rates. The gas mass flow rate resulting upon the combustion of a gas generant composition is typically a function of the surface area of the gas generant undergoing combustion and the burn rate thereof. Unfortunately, a limitation on the greater or more widespread use of basic copper nitrate in such gas generant compositions is that basic copper nitrate-containing gas generant compositions may exhibit or otherwise have associated therewith undesirably low or slow burn rates. In practice, the normal or typical burn rates associated with such gas generant compositions can act to restrict the use of such gas generant compositions to those applications wherein faster burn rates are neither required nor desired. For example, such low or slow burn rate compositions may be unsuited for various side impact applications where more immediate generation or supply of inflation gas may be required or desired.

For some inflator applications, a low gas generant formulation burn rate can be at least partially compensated for by reducing the size of the shape or form of the gas generant material such as to provide the gas generant material in a shape or form having a relatively larger reactive surface area. In practice, however, there are practical limits to the minimum size of the shape or form, such as a tablet, for example, to which gas generant materials can reproducibly be manufactured and increased burn rates may be needed for particular applications which require a higher inflator performance.

Thus, there is a need and a demand for methods or techniques for increasing the burn rate of a gas generant formulation as well as for non-azide based gas generant formulations having desirably increased or elevated burn rates.

SUMMARY OF THE INVENTION

A general object of the invention is to provide improved gas generant compositions.

A more particular object of the invention is to provide improved non-azide gas generant compositions.

A still more particular object of the invention is to provide a non-azide gas generant composition having a desirably enhanced burn rate.

A more specific objective of the invention is to overcome one or more of the problems described above.

The general object of the invention can be attained, at least in part, through an improvement to gas generant formulation including at least one non-azide nitrogen-containing organic fuel compound and basic copper nitrate as an oxidizer. In accordance with one preferred embodiment of the invention, such a gas generant formulation desirably includes between about 15 to about 60 formulation weight percent of a reaction product of basic copper nitrate and at least one transition metal complex of 5-aminotetrazole. Moreover, the at least one transition metal complex of 5-aminotetrazole and the basic copper nitrate are included in a weight ratio of no more than 1 part of the at least one transition metal complex of 5-aminotetrazole per 1 part of basic copper nitrate.

The prior art generally fails to provide as effective as may be desired methods or techniques for the raising of the burn rate of a gas generant formulation, particularly a non-azide, basic copper nitrate-containing gas generant formulation, to a level sufficient and desired for particular vehicular inflatable restraint system applications and in a manner practical and appropriate for such applications. Further, the prior art also generally fails to provide corresponding or associated non-azide gas generant formulations which exhibit sufficiently and effectively elevated burn rates as may be desired for such vehicular inflatable restraint system applications.

The invention further comprehends an ignitable gas generant composition having an enhanced burn rate. In accordance with one preferred embodiment of the invention such a gas generant composition includes:

- about 20 to about 45 weight percent of a gas generating fuel component comprising guanidine nitrate,
- about 20 to about 45 weight percent of a reaction product of basic copper nitrate and at least one copper complex of 5-aminotetrazole; and
- about 10 to about 35 weight percent of basic copper nitrate oxidizer unreacted with the copper complex of 5-aminotetrazole.

The invention still further comprehends a method for increasing the burn rate for a gas generant composition containing at least one non-azide nitrogen-containing organic fuel and a basic copper nitrate oxidizer in respective relative amounts. In accordance with one preferred embodiment of the invention such a method involves including in the gas generant composition at least about 15 composition weight percent of a reaction product of basic copper nitrate and at least one transition metal complex of 5-aminotetrazole. The reaction product is formed by a mixture containing the at least one transition metal complex of 5-aminotetrazole and the basic copper nitrate in a weight ratio of no more than 1 part of the at least one transition metal complex of 5-aminotetrazole per 1 part of basic copper nitrate.

As used herein, references to a specific composition, component or material as a "fuel" are to be understood to refer to a chemical which generally lacks sufficient oxygen to burn completely to $CO_2$, $H_2O$ and $N_2$.

Correspondingly, references herein to a specific composition, component or material as an "oxidizer" are to be understood to refer to a chemical generally having more than sufficient oxygen to burn completely to $CO_2$, $H_2O$ and $N_2$.

References herein to a "primary" fuel or oxidizer are to be understood to generally refer to a corresponding fuel or oxidizer present in the greatest concentration or relative amount.

Other objects and advantages will be apparent to those skilled in the art from the following detailed description taken in conjunction with the appended claims and drawing.

BRIEF DESCRIPTION OF THE DRAWING

The FIGURE is a simplified schematic, partially broken away, view illustrating the deployment of an airbag cushion from an airbag module assembly within a vehicle interior, in accordance with one embodiment of the invention.

DETAILED DESCRIPTION OF THE INVENTION

The present invention provides improved gas generant compositions such as used in the inflation of automotive inflatable restraint airbag cushions and, more particularly, to the enhancement of the rate at which such materials burn or otherwise react.

In accordance with one preferred embodiment of the invention, the invention involves an improvement to a gas generant formulation including at least one non-azide nitrogen-containing organic fuel compound and basic copper nitrate as an oxidizer. As described in greater detail below, such an improved gas generant formulation desirably includes a quantity or relative amount of a reaction product of basic copper nitrate and at least one transition metal complex of 5-aminotetrazole.

Suitable transition metal complexes of 5-aminotetrazole for use in the practice of the invention include those of copper and zinc, for example, with a copper complex of 5-aminotetrazole, e.g., copper II bis-aminotetrazole, currently being a preferred such material for use in the practice of the invention.

Those skilled in the art and guided by the teachings herein provided will appreciate that the invention can desirably be practice via the inclusion of a sufficient quantity of the reaction product of basic copper nitrate and at least one transition metal complex of 5-aminotetrazole in the gas generant formulation to effect a desirable increase in the burn rate exhibited by the resulting formulation, as compared to the same formulation without the inclusion of such reaction product. In general, however, it has been found preferable for a gas generant formulation in accordance with a preferred practice of the invention to include or incorporate such reaction product in a relative amount of at least about 15 wt. %, and, in accordance with certain preferred embodiments, in a relative amount of at least about 20 wt. %. in order to provide gas generant formulations evidencing a sufficiently increased burn rate effective for such inflatable restraint system applications. In general, it has been found preferable for a gas generant formulation in accordance with a preferred practice of the invention to include or incorporate such reaction product in a relative amount of no more than about 60 wt. %, and, in accordance with certain preferred embodiments, in a relative amount of no more than about 45 wt. %. Moreover, the at least one transition metal complex of 5-aminotetrazole and the basic copper nitrate are included in a weight ratio of no more than 1 part of the at least one transition metal complex of 5-aminotetrazole per 1 part of basic copper nitrate.

While the broader practice of the invention is not necessarily limited to the incorporation or use of such reaction product of basic copper nitrate and at least one transition metal complex of 5-aminotetrazole in combination or conjunction with particular or specific gas generant formulations, particularly gas generant formulations or compositions free of azide fuel, the invention is believed to have particular benefit or utility in gas generant formulations that include a primary fuel component composed of either or both one or more nitrogen-containing organic compounds and one or more transition metal complexes of nitrogen-containing organic compounds and basic copper nitrate as a primary oxidizer.

In general, gas generant formulations in accordance with the invention include a fuel material in a relative amount of at least 20 composition weight percent and up to about 45 composition weight percent. Gas generant formulations in accordance with certain preferred embodiments of the invention desirably contain or include a suitable fuel material in a relative amount of 25 to 40. Examples of suitable primary fuels for use in the practice of the invention include guanidine nitrate, guanylurea nitrate and copper II bis guanylurea dinitrate.

Furthermore, gas generant formulations in accordance with the invention desirably generally include or have an oxidizer content in the range of about 10 composition weight percent to about 35 composition weight percent, said oxidizer content being in addition to the reaction product of basic copper nitrate and at least one transition metal complex of 5-aminotetrazole. In accordance with certain preferred embodiments of the invention, such oxidizer content is, alternatively, largely or entirely composed of basic copper nitrate such as remains unreacted with the transition metal complex of 5-aminotetrazole. Thus, gas generant formulations in accordance with certain preferred embodiments of the invention desirably comprise about 10 composition weight percent to about 35 composition weight percent basic copper nitrate that is unreacted with the at least one transition metal complex of 5-aminotetrazole.

While compositions in accordance with the invention desirably contain or include basic copper nitrate as a primary oxidizer, such compositions may additionally contain or include one or more other oxidizer materials, albeit in general such other oxidizer materials are present in a significantly reduced relative amount as compared to the basic copper nitrate. Examples of such other oxidizer materials include ammonium nitrate, copper diammine dinitrate, and ammonium perchlorate, for example.

The gas generant compositions of the invention may also desirably include or contain a small amount, e.g., typically up to about 10 composition weight percent, of one or more gas generant composition additives. Suitable gas generant additives may, dependent on the specific application or use, may include one or more burn rate enhancing and slag formation additive or processing aid additive. For example, suitable burn rate enhancing and slag formation additives may, dependent on the specific application, include silicon dioxide, aluminum oxide, titanium dioxide, other refractory oxides, zirconium oxide, zinc oxide, alkali metal salts, alkaline earth metal salts and various combinations thereof.

Copper II bis-aminotetrazole is a transition metal complex of 5-aminotetrazole employed in accordance with one preferred embodiment of the invention. Copper II bis-aminotetrazole has the empirical formula, $Cu(CH_2N_5)_2$. Copper II bis-aminotetrazole has been found to exist in two isomeric forms that differ in color, green and purple. The compound can be formed or produced via various chemical reactions, including:

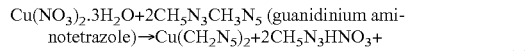

$$Cu(OH)_2+2CH_3N_5\ (5\text{-aminotetrazole})\rightarrow Cu(CH_2N_5)_2+2H_2O \quad (2)$$

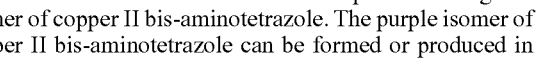

$$Cu(NO_3)_2.3H_2O+2CH_3N_5+2NH_4OH\rightarrow Cu(CH_2N_5)_2+2NH_4NO_3+5H_2O \quad (3)$$

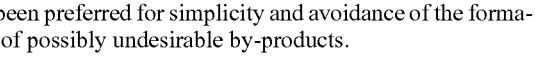

$$Cu(NO_3)_2.3H_2O+2CH_5N_3CH_3N_5\ (\text{guanidinium aminotetrazole})\rightarrow Cu(CH_2N_5)_2+2CH_5N_3HNO_3+3H_2O \quad (4)$$

All of the above reactions result in or produce the green isomer of copper II bis-aminotetrazole. The purple isomer of copper II bis-aminotetrazole can be formed or produced in each of the above reactions by including 2-4 equivalents of ammonia as a reactant. In current practice, above reaction (2) has been preferred for simplicity and avoidance of the formation of possibly undesirable by-products.

Those skilled in the art and guided by the teachings will further appreciate that various procedures or reaction schemes can be employed in the preparation of metal aminotetrazoles in accordance with the invention. For example, in accordance with one preferred practice of such reaction scheme, a spray-dry mix tank is charged with water. A selected quantity of 5-aminotetrazole is added to the spray-dry mix tank and partially dissolved in or with the water. Cupric hydroxide is then added to the contents of the spray-dry mix tank and the temperature of the slurry equilibrated at 190° F. and held at that temperature until the reaction is complete (approximately 1 hour). Other desired gas generant ingredients (e.g., fuel, basic copper nitrate, slagging aids, etc.) are then added to the reaction mixture slurry. The reaction mixture slurry can then be pumped to a nozzle and spray dried. A color change from green to blue during the drying process is evidence of reaction between copper II bis-aminotetrazole and basic copper nitrate, as such reaction has been found to occur in the absence of the other of the gas generant ingredients.

Equation (5), below, shows the reaction between copper II bis-aminotetrazole and basic copper nitrate.

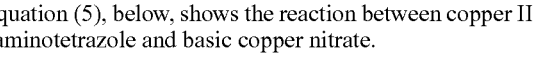

$$Cu(CH_2N_5)_2+3Cu(OH)_2.3Cu(NO_3)_2\rightarrow \text{blue reaction product} \quad (5)$$

The reaction product formed in reaction (5) has not yet been fully characterized but the gas generant properties thereof have been found to be repeatable from batch to batch.

Further processing steps such as blending, pressing, igniter coating, etc. or the like can then be performed per standard procedures.

TABLE 1, below, lists certain select properties of copper II bis-aminotetrazole in accordance with the invention.

TABLE 1

| PROPERTY | VALUE | |
|---|---|---|
| | Green Isomer | Purple Isomer |
| Thermal onset of decomposition | 150° C. | 150° C. |
| Color | green | purple |
| Water solubility | sparingly | sparingly |
| Content | (mass percent) | |
| copper | 31.06 | 28.30 |
| carbon | 8.68 | 8.75 |
| hydrogen | 2.20 | 3.12 |
| nitrogen | 48.12 | 55.17 |

As will be appreciated, gas generant compositions or materials prepared in accordance with the invention can be incorporated, utilized or practiced in conjunction with a variety of different structures, assemblies and systems. As representative, the FIGURE illustrates a vehicle 10 having an interior 12 wherein is positioned an inflatable vehicle occupant safety restraint system, generally designated by the reference numeral 14. As will be appreciated, certain standard elements not necessary for an understanding of the invention may have been omitted or removed from the FIGURE for purposes of facilitating illustration and comprehension.

The vehicle occupant safety restraint system 14 includes an open-mouthed reaction canister 16 which forms a housing for an inflatable vehicle occupant restraint 20, e.g., an inflatable airbag cushion, and an apparatus, generally designated by the reference numeral 22, for generating or supplying inflation gas for the inflation of an associated occupant restraint. As identified above, such a gas generating device is commonly referred to as an "inflator."

The inflator 22 contains a quantity of a gas generant composition or formulation in accordance with the invention and such as suited, upon ignition, to produce or form a quantity of gas such as to be used in the inflation the inflatable vehicle occupant restraint 20. As will be appreciated, the specific construction of the inflator device does not form a limitation on the broader practice of the invention and such inflator devices can be variously constructed such as is also known in the art.

In practice, the airbag cushion 20 upon deployment desirably provides for the protection of a vehicle occupant 24 by restraining movement of the occupant in a direction toward the front of the vehicle, i.e., in the direction toward the right as viewed in the FIGURE.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1 and Comparative Example 1

In these tests, 100 grams of each of the gas generant formulations having the compositions identified in TABLE 2 below were prepared.

The gas generant formulation of Example 1 by dissolving 14.68 grams of 5-aminotetrazole and 26.33 grams of guanidine nitrate in approximately 40 grams of water to form a solution. To this solution was added 8.43 grams of copper II hydroxide and allowed to react for approximately one hour at 190° F. After the reaction was completed, a dry blend of 50.67 grams of basic copper nitrate, 2.70 grams of $Al_2O_3$, and 0.30 grams of $SiO_2$ was stirred into the reaction mixture. The resulting mixture was then dried in a convection oven at 80° C. and granulated to 40 mesh.

The gas generant formulation of Comparative Example 1 was prepared in a similar manner but without the reaction step.

TABLE 2

| INGREDIENT | COMPARATIVE EXAMPLE 1 | EXAMPLE 1 |
|---|---|---|
| BCN | 46.62 | 50.67 |
| GN | 50.38 | 26.33 |

TABLE 2-continued

| INGREDIENT | COMPARATIVE EXAMPLE 1 | EXAMPLE 1 |
|---|---|---|
| $Cu(CH_2N_5)_2$ | -0- | 20.00 |
| $Al_2O_3$ | 2.70 | 2.70 |
| $SiO_2$ | 0.30 | 0.30 |

where,
BCN = basic copper nitrate and
GN = guanidine nitrate.

The gas generant formulation of each of Example 1 and Comparative Example 1 was then tested. The burn rate and density (ρ) values identified in TABLE 3 below were obtained. In particular, the burn rate data was obtained by first pressing samples of the respective gas generant formulations into the shape or form of a 0.5 inch diameter cylinder using a hydraulic press (12,000 lbs force). Typically enough powder was used to result in a cylinder length of 0.5 inch. The cylinders were then each coated on all surfaces except the top one with a krylon ignition inhibitor to help ensure a linear burn in the test fixture. In each case, the so coated cylinder was placed in a 1-liter closed test vessel capable of being pressurized to several thousand psi with nitrogen and equipped with a pressure transducer for accurate measurement of the pressure within the test vessel. A small sample of igniter powder was placed on top of the cylinder and a nichrome wire was passed through the igniter powder and connected to electrodes mounted in the test vessel lid. The test vessel was then pressurized to the desired pressure and the sample ignited by passing a current through the nichrome wire. Pressure vs. time data was collected as each of the respective samples were burned. Since combustion of each of the samples generated gas, an increase in test vessel pressure signaled the start of combustion and a "leveling off" of pressure signaled the end of combustion. The time required for combustion was equal to $t_2-t_1$ where $t_2$ is the time at the end of combustion and $t_1$ is the time at the start of combustion. The sample weight was divided by combustion time to give a burning rate in grams per second. Burning rates were typically measured at four pressures (900, 1350, 2000, and 3000 psi). The log of burn rate vs the log of average pressure was then plotted. From this line the burn rate at any pressure can be calculated using the gas generant composition burn rate equation (1), identified above. The results are shown in TABLE 3, below.

TABLE 3

| | COMPARATIVE EXAMPLE 1 | EXAMPLE 1 |
|---|---|---|
| $r_b$ | 0.52 | 0.93 |
| n | 0.54 | 0.54 |
| k | 0.013 | 0.023 |
| ρ (g/cc) | 1.91 | 2.10 |

where,
$r_b$ = burn rate at 1000 psi in inch per second (ips);
n = pressure exponent in the burn rate equation (1) identified above, where the pressure exponent is the slope of the plot of the log of pressure along the x-axis versus the log of the burn rate along the y-axis; and
k = the constant in the burn rate equation (1) identified above.

Discussion of Results

As shown in TABLE 3, the gas generant formulation of Example 1, which gas generant formulation included the reaction product of basic copper nitrate and copper II bis-aminotetrazole, in accordance with a preferred practice of the invention, experienced a significantly increased burn rate ($r_b$) as compared to the gas generant formulation of Comparative Example 1.

Further, as the pressure exponent (n) generally corresponds to the performance sensitivity of the respective gas generant material, with a lower burn rate pressure exponent corresponding to a gas generant material which desirably exhibits corresponding lesser or reduced pressure sensitivity, these examples show that the inclusion the reaction product of basic copper nitrate and copper II bis-aminotetrazole, in accordance with a preferred practice of the invention, can desirably increase the burn rate of the gas generant formulation without significantly increasing the pressure sensitivity of the resulting formulation.

As also shown in TABLE 3, the gas generant formulation of Example 1 and in accordance with the invention had a density which was significantly greater than the gas generant formulation of Comparative Example 1. Those skilled in the art and guided by the teachings herein provided will appreciate that gas generant formulations of increased density can desirably be used such as to increase the volume of gas produced on a unit volume basis and thereby at least partially offset any decrease in the moles of gas produced on a mass basis associated with replacement of some of the guanidine nitrate due to the inclusion of copper II bis-aminotetrazole in the preparation, in accordance with the invention.

Thus, the invention provides effective methods or techniques for desirably raising or increasing of the burn rate of a gas generant formulation, particularly a non-azide gas generant formulation, to a level sufficient and desired for vehicular inflatable restraint system applications and in a manner practical and appropriate for such applications. Further, the invention also provides effective corresponding or associated non-azide gas generant formulations which exhibit sufficiently and effectively elevated burn rates as may be desired in particular vehicular inflatable restraint system applications.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. In a gas generant formulation free of azide fuel, the gas generant formulation including at least one non-azide nitrogen-containing organic fuel compound and basic copper nitrate as an oxidizer, the improvement of including between about 15 to about 60 formulation weight percent of a reaction product of basic copper nitrate and at least one transition metal complex of 5-aminotetrazole, wherein the at least one transition metal complex of 5-aminotetrazole and the basic copper nitrate are included in a weight ratio of no more than 1 part of the at least one transition metal complex of 5-aminotetrazole per 1 part of basic copper nitrate.

2. The improvement of claim 1 wherein the at least one transition metal is zinc.

3. The improvement of claim 1 wherein the at least one transition metal is copper.

4. The improvement of claim 3 wherein the copper complex of 5-aminotetrazole is copper II bis-aminotetrazole.

5. The improvement of claim 3 wherein the copper complex of 5-aminotetrazole is formed by reacting two equivalents of 5-aminotetrazole with one equivalent of cupric hydroxide in an aqueous slurry and at a heated temperature.

6. The improvement of claim 1 wherein the at least one non-azide nitrogen-containing organic fuel compound is guanidine nitrate.

7. The improvement of claim 1 wherein the gas generant formulation has a fuel content of about 20 to about 45 weight percent.

8. The improvement of claim 7 wherein the gas generant formulation has an oxidizer content of about 10 to about 35 weight percent in addition to the reaction product of basic copper nitrate and at least one transition metal complex of 5-aminotetrazole.

9. The improvement of claim 7 wherein the gas generant formulation comprises about 10 to about 35 weight percent of basic copper nitrate unreacted with the at least one transition metal complex of 5-aminotetrazole.

10. The improvement of claim 1 wherein the gas generant formulation has an oxidizer content of about 10 to about 35 weight percent in addition to the reaction product of basic copper nitrate and at least one transition metal complex of 5-aminotetrazole.

11. The improvement of claim 1 wherein the gas generant formulation comprises about 10 to about 35 weight percent of basic copper nitrate unreacted with the at least one transition metal complex of 5-aminotetrazole.

12. The improvement of claim 1 wherein the gas generant formulation comprises at least about 20 formulation weight percent of the reaction product of basic copper nitrate and at least one transition metal complex of 5-aminotetrazole.

13. The improvement of claim 1 wherein the gas generant formulation comprises no more than about 45 formulation weight percent of the reaction product of basic copper nitrate and at least one transition metal complex of 5-aminotetrazole.

14. An ignitable gas generant composition having an enhanced burn rate, said composition comprising:

about 20 to about 45 weight percent of a gas generating fuel component comprising guanidine nitrate, about 20 to about 45 weight percent of a reaction product of basic copper nitrate and at least one copper complex of 5-aminotetrazole; and about 10 to about 35 weight percent of basic copper nitrate oxidizer unreacted with the copper complex of 5-aminotetrazole.

15. The ignitable gas generant composition of claim 14 wherein the reaction product of basic copper nitrate and at least one copper complex of 5-aminotetrazole is formed by a reaction of no more than 1 part by weight of the at least one transition metal complex of 5-aminotetrazole per 1 part by weight of basic copper nitrate.

16. The ignitable gas generant composition of claim 14 wherein the copper complex of 5-aminotetrazole is copper II bis-aminotetrazole.

17. The ignitable gas generant composition of claim 14 wherein the copper complex of 5-aminotetrazole is formed by reacting two equivalents of 5-aminotetrazole with one equivalent of cupric hydroxide in an aqueous slurry and at a heated temperature.

18. In a gas generant composition containing at least one non-azide nitrogen-containing organic fuel and a basic copper nitrate oxidizer in respective relative amounts, the composition having a burn rate, a method for increasing the burn rate for the gas generant composition, said method comprising:

including in the gas generant composition at least about 15 composition weight percent of a reaction product of basic copper nitrate and at least one transition metal complex of 5-aminotetrazole, the reaction product formed by a mixture containing the at least one transition metal complex of 5-aminotetrazole and the basic copper nitrate in a weight ratio of no more than 1 part of the at least one transition metal complex of 5-aminotetrazole per 1 part of basic copper nitrate.

19. The method of claim 18 wherein the at least one transition metal is copper.

20. The improvement of claim 1 wherein said reaction product of basic copper nitrate and the at least one transition metal complex of 5-aminotetrazole is formed from a mixture comprising the basic copper nitrate and the at least one transition metal complex of 5-aminotetrazole at a heated temperature.

21. The ignitable gas generant composition of claim 14 wherein said reaction product of basic copper nitrate and at least one copper complex of 5-aminotetrazole is formed from a mixture comprising the basic copper nitrate and the at least one transition metal complex of 5-aminotetrazole at a heated temperature.

22. The method of claim 18 wherein the mixture containing the at least one transition metal complex of 5-aminotetrazole and the basic copper nitrate in a weight ratio of no more than 1 part of the at least one transition metal complex of 5-aminotetrazole per 1 part of basic copper nitrate is at a heated temperature to form said reaction product.

* * * * *